US007272996B2

(12) United States Patent
Pontieri

(10) Patent No.: US 7,272,996 B2
(45) Date of Patent: Sep. 25, 2007

(54) SPANNER SOCKET

(76) Inventor: James Matthew Pontieri, 36291 Jared, Sterling Heights, MI (US) 48312

( * ) Notice: Subject to any disclaimer, the term of this patent is extended or adjusted under 35 U.S.C. 154(b) by 170 days.

(21) Appl. No.: 11/047,832

(22) Filed: Feb. 1, 2005

(65) Prior Publication Data

US 2006/0169109 A1 Aug. 3, 2006

(51) Int. Cl.
*B25B 13/48* (2006.01)
*B25B 13/58* (2006.01)
*B25B 13/28* (2006.01)

(52) U.S. Cl. ..... 81/176.15; 81/180.1; 81/90.1

(58) Field of Classification Search ..... 81/176.15, 81/176.2, 180.1, 185.1, 58.2, 90.1, 60, 177.2; D8/21
See application file for complete search history.

(56) References Cited

U.S. PATENT DOCUMENTS 1,882,462 A 10/1932 Weber
2,605,665 A * 8/1952 Grenat ..... 81/124.4
2,803,981 A 8/1957 Stoecker
3,010,347 A 11/1961 Korn
3,731,560 A 5/1973 Bares
4,210,037 A 7/1980 Taylor
4,227,429 A * 10/1980 Bowers et al. ..... 81/176.15
4,757,729 A 7/1988 Martinmaas
5,090,273 A * 2/1992 Fossella ..... 81/57.13
5,261,263 A * 11/1993 Whitesell ..... 72/409.19
5,845,552 A * 12/1998 Piascik ..... 81/461
6,058,813 A * 5/2000 Bryant et al. ..... 81/176.15
6,076,435 A * 6/2000 White et al. ..... 81/176.2
6,131,494 A * 10/2000 Quenneville ..... 81/125.1
D434,290 S * 11/2000 McMullin ..... D8/21
6,186,034 B1 2/2001 Lamons
6,227,076 B1 * 5/2001 Murray ..... 81/58.2
6,283,449 B1 * 9/2001 Hu ..... 254/26 R
6,450,069 B1 * 9/2002 Brahmbhatt ..... 81/176.2
6,523,440 B2 2/2003 Friedman et al.
6,860,688 B2 3/2005 Bushell et al.
7,069,821 B2 * 7/2006 Hwang ..... 81/176.3
2002/0088315 A1 * 7/2002 Thurman et al. ..... 81/176.15
2002/0192048 A1 12/2002 Bushell et al.
2003/0029280 A1 * 2/2003 Adamczyk et al. ..... 81/176.3
2004/0065176 A1 * 4/2004 Lin ..... 81/125
2005/0147482 A1 7/2005 Bushell et al.

* cited by examiner

*Primary Examiner*—Alvin J. Grant
(74) *Attorney, Agent, or Firm*—J. Gordon Lewis

(57) ABSTRACT

A spanner socket for application with conventional hand tools such as ratchet drivers and fixed wrenches employed for imparting torque to a work piece about an axis of rotation includes a generally cylindrical shaped base member which defines a predetermined number of engagement surfaces which are circumferentially arranged around the axis of rotation. The engagement surfaces are employed for releasably coupling with the associated hand tool. Two or more elongated drive pins are carried by the base member for rotation therewith about said axis of rotation. Each drive pin defines an axis of elongation, which is parallel to the axis of rotation and spaced from the axis of rotation for engagement with the work piece for the application of torque thereto.

6 Claims, 3 Drawing Sheets

FIG - 2
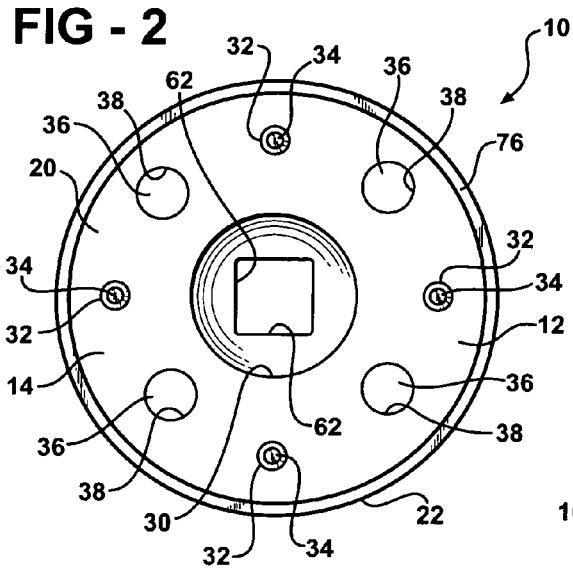
FIG - 4
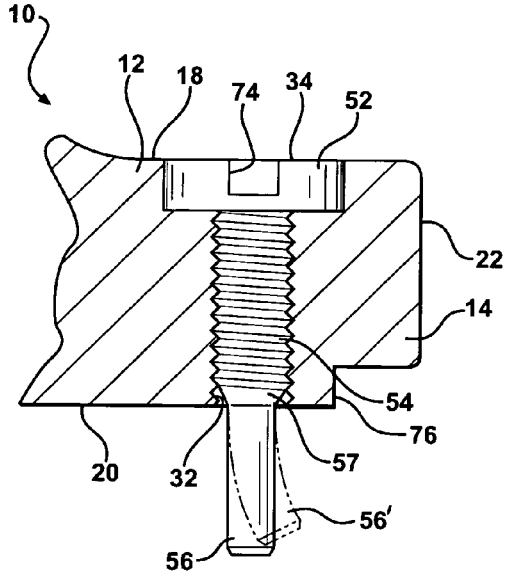
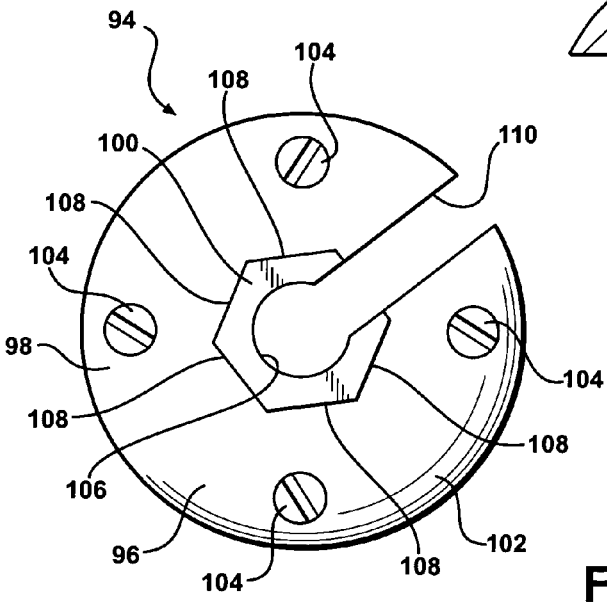
FIG - 6

SPANNER SOCKET

The present invention relates generally to spanner wrenches, i.e. wrenches having a pair of projections which may be engaged in spaced apart holes, slots, notches or other forms of tool receiving recesses formed in an article to be turned. More specifically, the present invention relates to devices adaptable for use which conventional standard hand tools to manipulate threaded nuts, collets, ferrules and similar mechanical fastening devices.

BACKGROUND OF THE INVENTION

Spanner wrenches of various forms and configurations have been in use for many years. They have proven to be especially useful in applications where traditional open or closed wrenches, crescent wrenches, pliers and the like cannot be useful due to interference from nearby structures or the need for the application of extremely high levels of torque to the associated mechanical fastening device. Frequently, spanner wrenches are designed for a specific application, such as applying torque axially to a mechanical fastening device located in a restricted area such as a blind cavity, where conventional tools cannot be applied.

A major shortcoming of historical spanner wrench designs arises from their tendency toward special applications. Artisans and tradesmen were required to acquire a spanner wrench for each applications and distinct fastener size that he may encounter. Thus, over time they will be obligated to incur substantial costs as well as maintain a large and bulky tool collection.

Producers of industrial power tools, such as hand grinders employing consumable aggregate grinding wheels frequently employ spanner nuts for specialized applications. A prime example is the retention of grinding and cut-off wheels, which, by their nature, must be regularly replaced. As a result, the power tool producers are obligated to provide equally specialized spanner wrenches as an adjunct to the power tools. These spanner tools are prone to loss, damage and wear. Power tools designed for mass merchandizing to the general public similarly employ specialty spanner tools. But in their case frequently suffer from poor design and quality as the manufacturer focuses on low cost processes. In both cases, a lost, worn or defective tool can destroy the utility of an expensive power tool. Lastly, replacement spanner tools can be difficult to obtain inasmuch as they are frequently produced by only a single manufacturer.

The forgoing problems have been partially overcome by various improvements over the years. For example, there are several adjustable spanner wrenches described in the patent literature which provide an adjustable span between slots in a mechanical fastening device.

U.S. Pat. No. 2,803,981, shows a spanner wrench in which a pivotally mounted bar at the base of the wrench has a slot wherein drive pins are mounted. The span between the drive pins is adjusted by moving the drive pins within the slots and the drive pins are tightened at a desired position by nuts mounted on a threaded upper portion of the drive pin. The spanner wrench according to the '981 patent has the disadvantage that as the tightening nuts become loosened, the drive pins slide along the slots and it is difficult to maintain the proper spacing. Also, with wear, the drive pins would tend to slide in the slots, thus limiting the usefulness of the wrench. Further, the range of adjustment is limited to twice the length of the slot.

Another adjustable spanner wrench is described in U.S. Pat. No. 3,010,347, in which the L-shaped members are attached to the movable and fixed jaws of a crescent wrench. Adjustment of spacing is made by opening or closing the jaws of the crescent wrench. While the '347 patent shows a device which has a certain amount of flexibility, the handle of the crescent wrench must be relatively at a right angle to the axis about which the article is to be turned. In many applications where space is limited, such a wrench would not be usable.

Another adjustable spanner wrench in the prior art is illustrated in U.S. Pat. No. 3,731,560, which teaches of a wrench having a Y-shaped handle wherein each of the branches of the Y had a hole therein to accept a disc which is rotatably mounted in the hole and wherein the disc has a drive pin mounted near the edge of one face thereof An adjustable spanner wrench according to the '560 patent is limited to a range of adjustment which is equal to twice the diameter of the discs mounted in the holes the Y-shaped handle. Also, as above, the handle must be at a right angle to the article, which is to be turned.

Still another adjustable spanner wrench is disclosed in U.S. Pat. No. 4,210,037. The '037 patent represents an improvement over the design of the '560 patent, but suffers from many of its shortcomings. The assemblies which effect the adjustability are difficult to adjust with substantial precision and inevitably tend to loosen during use promoting rapid wear. Furthermore, the long handles typically found on prior art spanner wrenches do not lend themselves to smaller scale applications.

Universal among the above described prior art spanner wrenches are their excessive specialization coupled with their lack of robust design suitable for application of large torque levels while affording great flexibility in downscaling and application in conjunction with other more common hand tools.

The present invention overcomes the forgoing difficulties of traditional spanner wrench designs by providing a spanner socket, which can be employed either by itself or with ubiquitous hand tools such as ratchets or wrenches as force multipliers. The invention further provides for adjustability of spacing as well as the number of drive pins, rendering a device well adaptable for many varied applications. Lastly, the invention facilitates the easy removal and replacement of worn drive pins and reconfiguration of the types and positioning of various pin sets.

BRIEF DESCRIPTION OF THE INVENTION

An object of the present invention is to develop a low cost spanner socket suitable for use by itself or, preferably with a traditional socket wrench. Drive pins designed to engage and apply torque to a work piece such as a spanner nut can be replaced when worn, and readjusted, reconfigured and reoriented for specific applications, giving the tool great utility and flexibility of use.

According to the present invention, a spanner socket is adapted for application with a driving tool, which is configured for releasable coupling therewith for selectively imparting torque to a work piece about an axis of rotation. The inventive spanner socket comprises a generally cylindrical base member defining a plurality of engagement surfaces circumferentially arranged about the axis of rotation for coupling with the driving tool. Furthermore, a plurality of elongated drive pins are carried by said base member for rotation about the axis of rotation and said pins are spaced from the axis of rotation for engagement with the work piece for the application of torque thereto.

As an additional feature, the spanner socket's base member has a axial passage formed there through for receiving apportion of the driving tool as well as providing a recess for receiving an axially extending central portion of a work piece. This arrangement provides a simple compact design, which is extremely robust structurally.

According to another aspect of the invention, the spanner socket's base member has circumferentially disposed flats arranged on the external surface thereof to provide for use of external force multipliers, such as adjustable wrenches. This arrangement provides additional flexibility and utilitarian design.

According to another aspect of the invention, each drive pin includes a stepped shank portion adapted for engaging a parallel bore within the base member, a work piece engaging portion having a characteristic cross-sectional dimension somewhat smaller than that of the shank portion and a head portion having a characteristic cross sectional dimension somewhat larger than that of the shank portion. This arrangement provides a design to facilitate easy removal and reconfiguration of drive pin sets and means for precisely limiting axial positioning of each drive pin with respect to the base member.

According to still another aspect of the invention, the base member includes a radially extending sector shaped opening formed therein for radial positioning of the spanner socket with a work piece. This arrangement has the advantage of applying the inventive spanner socket on mechanical fastening devices concentrically joined on an elongated work piece such as a pipe or conduit where neither end is accessible. In this case, the spanner socket can be positioned concentrically with the work piece, engage the mechanical fastening device as well as a driving tool.

According to yet another aspect of the invention, the base member is formed in two or more discrete pieces which preferably comprise an inner ring member removably nestingly engaging with a substantially concentric outer ring member for rotation therewith, wherein the outer ring member carries said drive pins and both of the ring members define engagement surfaces for affixation with a driving tool. This arrangement has the advantage of allowing the base member to be reconfigured for use with different types of driving tools and with different configurations of work pieces.

These and other features and advantages of this invention will become apparent upon reading the following specification, which, along with the drawings, describes and discloses preferred and alternative embodiments of the invention in detail.

BRIEF DESCRIPTION OF THE DRAWINGS

FIG. 2, is a bottom plan view of the spanner socket of FIG. 1;

FIG. 4, is a broken, sectional view on an enlarged scale of a portion of the spanner socket of FIG. 3

FIG. 6, is a top plan view of another alternative embodiment of the present invention;

DETAILED DESCRIPTION OF THE PREFERRED AND ALTERNATE EMBODIMENTS OF THE INVENTION

Figures 1, 3:
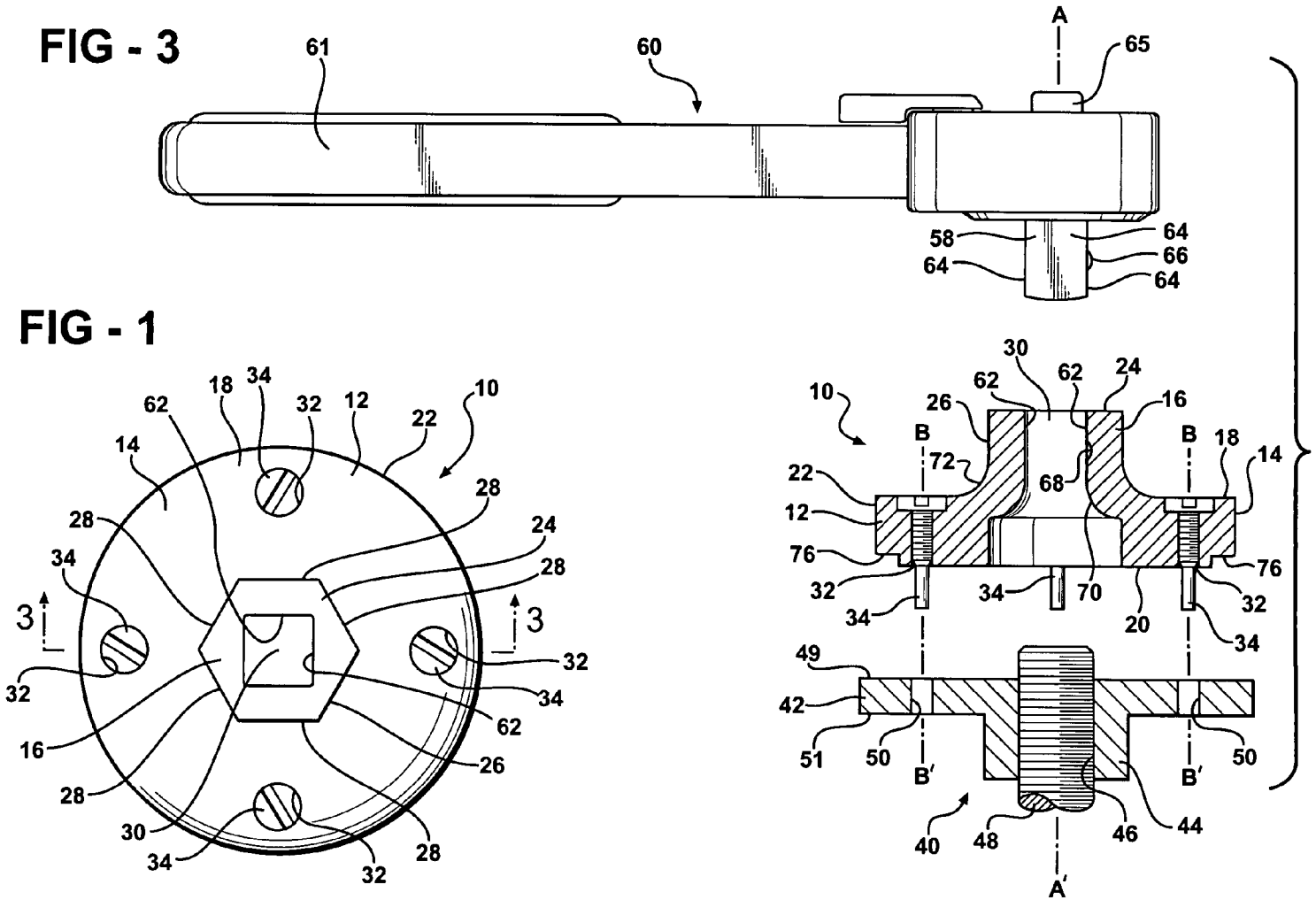
FIG. 1, is a top plan view of a spanner socket in accordance with the invention.
FIG. 3, is an exploded side view of the spanner socket of FIG. 1 in application with a driving tool and a mechanical fastening device with the mechanical fastening device illustrated in cross-section and the spanner socket shown in cross-section taken on lines II-II of FIG. 1.

FIGS. 1 and 2 illustrate a preferred embodiment of the present invention. A spanner socket 10 is constructed as a base member 12 including a generally cylindrical portion 14 and a faceted extension portion 16. Generally cylindrical portion 14 has an upper surface 18, a lower surface 20 and a circumferential outer edge surface 22. Cylindrical portion 14 is symmetrically formed about a vertical axis A-A' (see FIG. 3). Extension portion 16 is also symmetrically formed about axis A-A' and extends upwardly from upper surface 18 of cylindrical portion 14. Extension portion 16 has an upper surface 24 and a faceted circumferential outer edge portion 26. Surfaces 18, 19 and 24 are disposed generally parallel to one another and normal to axis A-A'.

Faceted edge portion 26 defines a number, of radially outwardly facing flats or engagement surfaces 28 of equal size circumferentially arranged around axis A-A'. Preferably, edge portion 26 is formed as a hex-head of standard size such to accept a conventional ⅞-inch drive socket or similar conventional hand tool. Although illustrated as having six flats 28, edge portion 26 could have fewer or more flats 28, and vary dimensionally without departing from the spirit of the present invention.

It is to be understood that use of the terms "upper", "lower", "left", "right", "vertical", "horizontal" and the like in this specification are in reference to the drawing figures and are intended only to facilitate a clear understanding of the structures described herein, and are not to be construed as limiting when interpreting the scope of the claims.

Base member 12 is preferably constructed of case hardened tool steel with a chromium finish. However, for low cost or less demanding applications, other materials such as mild steel, aluminum or even polymeric materials could be substituted. Likewise, cylindrical portion 14 and extension portion 16 are preferably integrally formed for maximum strength. However, they could alternatively be formed separately and joined by physical attachment means, welding or the like.

Spanner socket 10 defines a relatively large central bore 30 disposed concentrically about axis A-A' and extending there through. Bore 30 terminates upwardly through upper surface 24 of extension portion 16 and downwardly through lower surface 20 of cylindrical portion 14 of base member 12.

A plurality of relatively small diameter bores 32 are formed within cylindrical portion 14, extending between upper and lower surfaces 18 and 20, respectively, thereof Each small diameter bore 32 defines a vertical axis B-B' (see FIG. 3) circumferentially arranged about the radially outer portion of cylindrical portion 14. Thus, each axis B-B' is parallel to and radially equally spaced from axis A-A' as well as equally spaced from the two circumferentially closest axes B-B'. In the preferred embodiment of the invention, there are four bores 32 located at clockwise 3:00, 6:00, 9:00 and 12:00 positions. The reasons for this preference will be described herein below.

An elongated drive pin 34 is disposed in each bore 32 and fixedly attached to base member 12.

Four permanent magnets 36 are nestingly embedded or press fit within blind bores 38 opening through the lower surface 20 of cylindrical portion 14 of base member 12. Magnets 36 are flush mounted within bores 38 so as to not extend below lower surface 20. The magnets are clockwise positioned at 1:30, 4:30, 7:30 and 10:30. In application, the magnets serve to attract and hold in place work pieces such as mechanical fastening devices formed of ferrous materials.

Referring to FIG. 3, in addition to FIGS. 1 and 2, a preferred application of spanner socket 10 is illustrated. Spanner socket 10 is primarily designed to facilitate turning (loosening and tightening) work pieces such as a spanner nut 40. The illustrated spanner nut 40 engages a threaded shaft for cinching and retaining a load (not illustrated) such as a grinding or cutting wheel mounted to a power tool. Spanner nut 40 consists of a flange 42 extending radially outwardly from an integral boss 44. Boss 44 forms a threaded bore 46 for engaging a threaded output shaft 48 which emerges from below the spanner nut 40, passes through bore 46 and terminates slightly above the upper surface 49 of the flange 42. The flange 42 defines tool-engaging openings 50, such as through bores therein. In application, the boss 44 serves to keep the grinding/cutting wheel aligned with shaft 48 and the lower surface 51 of the flange 42 presses downwardly against the grinding/cutting wheel to axially fix the wheel with respect to the shaft 48.

Each drive pin 34 is formed of hardened tool steel and has an axis of elongation concentric with axis B-B'. As best seen in FIG. 4, each drive pin 34 is elongated with a stepwise varying characteristic cross-section. The upper end of each drive pin 34 forms a relatively large diameter pan head 52 which transitions into threaded shank portion 54 of intermediate cross-section disposed entirely within bore 32. The inner diameter of each bore 32 is likewise threaded to engage and axially fix the drive pin 34 with respect to the base member 12. The upper surface of head 52 is substantially flush with upper surface 18 of cylindrical portion 14. The lower end of shank portion 54 transitions into a work piece-engaging portion 56 via an intermediate chamfer 57. The characteristic cross section of the work piece-engaging portion 56 of drive pin 34 is slightly smaller than that of the shank portion 54.

The work piece engaging portion 56 of each drive pin 34 extends downwardly below lower surface 20 of cylindrical portion 14 an amount roughly the same dimension as the axial depth of the tool engaging opening 50 of the spanner nut 40. This ensures the maximum 'bite', i.e. provides the maximum surface area engagement between the outer surface of each drive pin 34 with the inner surface of the associated tool receiving openings 50, minimizing unit loading with attendant wear and damage to the drive pins 34.

In application, lower surface 20 of base member 12 is flush (substantially coplanar) against the upper surface 49 of the flange 42 of the spanner nut. 40. The spanner socket 10 and spanner nut 40 are held in juxtaposition by downward pressure applied by the tool user as well as magnetic attraction effected by permanent magnets 36. In this orientation, drive pins 34 are fully engaged within openings 50 and the upper portion of output shaft 48 extends within central through bore 30. In this manner, user applied torque on the spanner socket will be applied to the spanner nut 40 through the drive pins 34. As long as precise alignment is maintained, the drive pins are subjected to almost exclusively shear forces and virtually no bending forces.

Referring to FIGS. 1, 2 and 3, the shape of central through bore 30 transitions throughout its vertical extent. The upper portion of through bore 30 has a substantially square cross-section dimensioned to nestingly receive a ½ inch drive member 58 of a conventional ratchet driver 60 intended for drive sockets. Ratchet driver 60 includes an elongated handle 61 intended to be grasped by the user and serves to supply force or torque amplification when used in its intended manner. The square portion of through bore 30 defines four radially inwardly directed flats or engagement surfaces 62 which receive user applied torque from the four abutting surfaces 64 of drive member 58 of ratchet driver 60.

Ratchet driver 60 includes a push to release function including a spring loaded button 65 which acts to release a detent ball 66 which, in application, engages a hemispherical concave recess 68 formed in one or more of the flats 62 of through bore 30. This arrangement serves to retain ratchet driver 60 in assembly with spanner socket 10 unless selectively released by the user.

The lower portion of through bore 30 transitions into a generally circular cross-section at its lowermost extent adjacent lower surface 20 of cylindrical portion 14 of base member 12. The lower portion of through bore 30 is enlarged to facilitate receiving various configurations of spanner nuts 40 and associated mounting hardware such as the uppermost end of output shaft 48.

An intermediate transition zone is a gently rounded convex fillet 70. Likewise, the transition point between the outer edge portion 26 of extension portion 16 and the upper surface 18 of cylindrical portion 14 of base member 12 is a large fillet 72. Fillets 70 and 72 uniformly circumscribe central through bore 30 and materially aid in providing an extremely strong and robust design.

In the preferred embodiment of the invention, the drive pins 34, which are subject to wear and abuse, are removable and replaceable. In the embodiment described in FIGS. 1-4, the drive pins 34 are provided with enlarged head portions 52 to ensure precise extension of the drive pins 34 below the lower surface 20 of the cylindrical portion 14 of the base member 12. Furthermore, as a marketing feature, a spanner socket 10 can be merchandized with different sets of drive pins 34 of varying diameters for various applications. This would enhance the utility of the tool. Furthermore, some of the drive pins 34 could be temporarily removed for applications requiring fewer than four (for example: two) drive pins 34.

As best seen in FIG. 4, a bent or damaged work piece engagement portion 56 of a drive pin 34, as illustrated in phantom at 54', can be replaced due to the reduced diameter of the work piece engagement portion 56 contrasted with the diameter of small bores 32.

The upper surface of head portion 52 of drive pins 34 has a tool receiving recess 74 suitable for a screwdriver. Alternative recess designs could be substituted, such as for an Allen wrench, without departing from the spirit of the invention.

A circumferential recess 76 is provided at the intersection of the lower surface 20 and circumferential outer edge surface 22 of the cylindrical portion 14 of the base member 12. When in application as described hereinabove, recess 76 is still accessible to a prying tool when spanner socket 10 is engaged with a spanner nut 40. Should an over torque condition occur and the work piece engaging portions 56 deform sufficiently to lock the spanner socket 10 and spanner nut 40 together, they can be easily manually separated with any suitable prying tool. Although tool receiving recess 76 is illustrated as circumferentially continuous, segmented radially outwardly opening recesses could be substituted.

Figure 5:
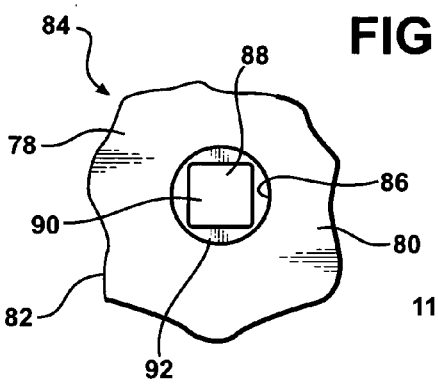
FIG. 5, is a broken bottom plan view on an enlarged scale of a portion of an alternative embodiment of the present invention.

Referring to FIG. 5, an alternative design of the drive pin 34 from the embodiments illustrated in FIGS. 1-4 is shown. Viewed from the bottom, a broken portion of the lower surface 78 of a generally cylindrical portion 80 of a base member 82 of an alternative design spanner socket 84 is illustrated. The illustrated bottom portion 78 includes the bottom end of a small bore 86 containing an elongated drive pin 88. The drive pin 88 and its attachment to the base member 82 is identical in all material respects to the earlier described embodiment with the exception that the work piece engaging portion 90 of drive pin 88 is square in cross-section. The shank portion 92 is a round thread form as described hereinabove.

This embodiment would be applicable for use with spanner nuts containing tool receiving radial slots therein, as opposed tool receiving bores.

Referring to FIG. 6, a spanner socket 94 containing an alternative design is illustrated. Spanner socket 94 is substantially identical in all material respects to spanner socket 10 described in conjunction with FIGS. 1-4, except as described herein. The top view of spanner socket 94 illustrates a base member 96 including a generally cylindrical portion 98 and a faceted extension portion 100 affixed to the top surface 102 of the cylindrical portion 98. The uppermost ends of four drive pins 104 are circumferentially arranged radially externally of extension portion 100.

An axially aligned central through bore 106 is illustrated as having a round cross-section as it extends upwardly through the faceted extension portion 100. This design requires the user to apply any torque enhancing tool to radially outwardly facing flats or engagement surfaces 108.

A generally radially extending work piece access slot 110 cuts entirely through both a sector of generally cylindrical portion 98 and an aligned sector of faceted extension portion 100. This arrangement permits spanner socket 94 to be applied with work pieces having threaded mechanical spanner fasteners applied to endless, or at least very long structures which extend out of and into the drawing figure as viewed in FIG. 6, well beyond spanner socket 94 in both directions. The work piece access slot 110 is tangentially wide enough to accept the endless structure radially inwardly there through and into axial alignment within central bore 106.

Figure 7:
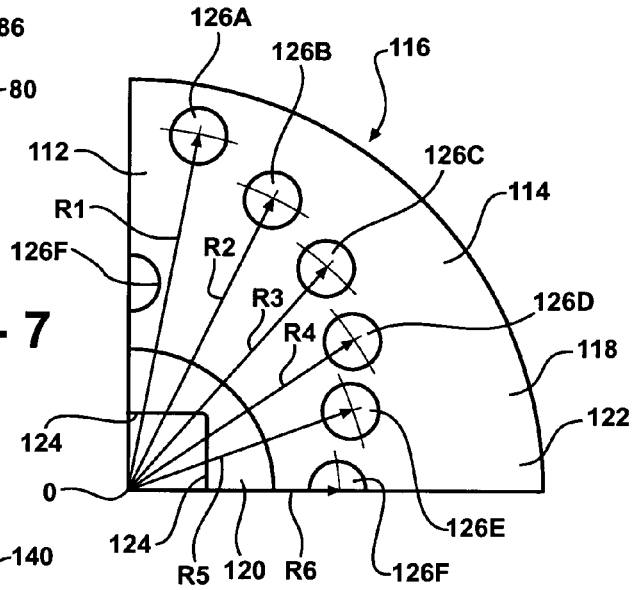
FIG. 7, is a quartile segment of an enlarged scale on the top plan view of yet another alternative embodiment of the present invention.

Referring to FIG. 7, an additional feature of the present invention is illustrated in a quartile segment 112 of a base member 114 of an alternative spanner socket 116. Only one quartile segment 112 is illustrated for the sake of simplicity, it being understood that in the contemplated implementation of this embodiment of the invention, segment 112 would be replicated four times (for each quartile).

FIG. 7 illustrates, in top view, a segment of the generally cylindrical portion 118 and a faceted extension portion 120 of a base member 122 of spanner socket 116. Spanner socket 116 is substantially identical to those described hereinabove in all material respects with the exception of those features set forth herein. The faceted extension portion 120 is round on the radially outwardly facing surface thereof and defines four radially inwardly facing flats or engagement surfaces 124 (portions of only two are illustrated), necessitating usage of a torque multiplying hand tool such as the ratchet driver 60 described in connection with FIG. 3.

A series of small bores 126A-F extending normally into cylindrical portion 118 of spanner socket 116 are each spaced at a different radius, designated R1-6, respectively, from the origin, designated O. Bores 126 are all of the same diameter and otherwise are adapted to accept elongated drive pins (not shown) of common design. This arrangement permits the reconfiguration of an array of drive pins on base member 114 to accommodate a wide variety of spanner nuts and similar mechanical fastening devices.

Although it is considered preferable to set up an array of drive pins symmetrically for any given situation, other options are possible. If the drive pins are not set up symmetrically, the resulting use of the spanner socket will result in an offset in the torsional axis applied by the torque multiplying tool and the torsional axis applied by the spanner socket to the work piece. This offset will result in bending loads, which, if excessive, could be damaging to the spanner socket and associated tools.

For unique situations, such as encountering nonstandard spanner nuts, the present invention permits configuring the drive pins in a non-symmetrical arrangement.

Figure 8:
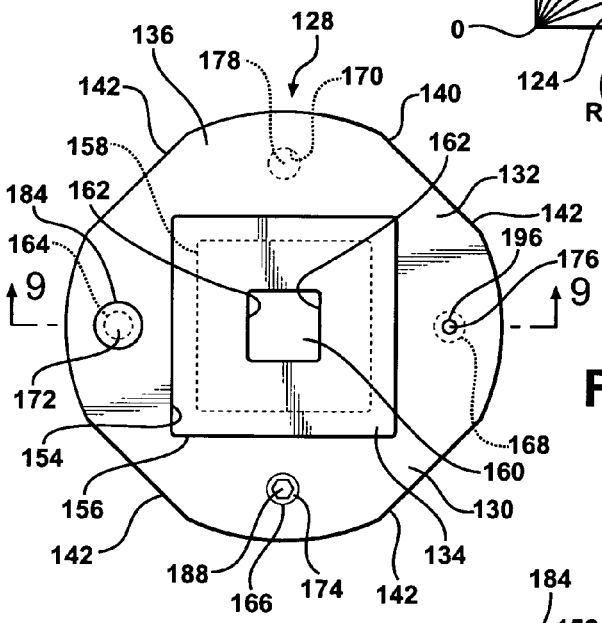
FIG. 8, is a top plan view of another alternative embodiment of the present invention.
Figure 9:
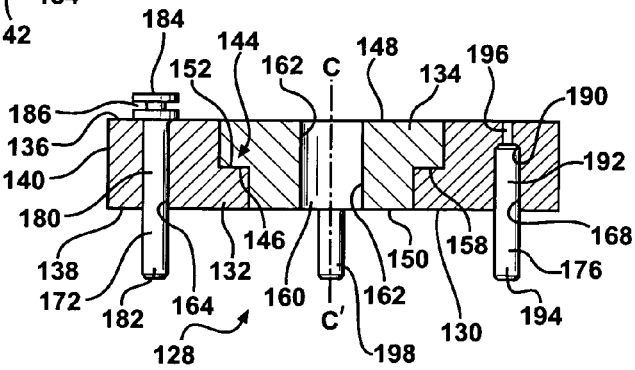
FIG. 9, is a cross-sectional view taken on lines IX-IX of FIG. 8.

Referring to FIGS. 8 and 9, still another alternative embodiment of the present invention is described. A spanner socket 128 is constructed as a base member 130 including a generally cylindrical outer portion 132 and an inner portion 134. Each is preferably constructed of case hardened tool steel with a chromium finish. Generally cylindrical outer portion 132 has an upper surface 136, a lower surface 138 and circumferential outer edge surface 140. Cylindrical portion 132 is symmetrically formed about a vertical axis C-C' (as viewed in FIG. 9) and defines a plurality, preferably four, radially outwardly directed flats or engagement surfaces 142 on outer edge surface 140. Flats 142 are dimensionally the same size and are circumferentially equally spaced.

Inner portion 134 of base member 130 is also symmetrically formed about axis C-C'. Inner portion 134 is nestingly disposed within a pocket 144 formed by a shaped, radially inwardly directed wall surface 146 of outer portion 132 of base member 130. Inner portion 134 has an upper surface 148, a lower surface 150 and a shaped, radially outwardly directed wall surface 152. Wall surface 146 of outer portion 132 and wall surface 152 of inner portion 134 are complimentary, whereby when juxtaposed as illustrated in FIG. 9, they essentially mirror image one another and lockingly engage to ensure that when torque is applied to spanner socket 128, outer and inner portions 132 and 134, respectively, rotate in unison about axis C-C' and remain in fixed axial alignment as if they were integrally formed as a single piece.

In the embodiment illustrated in FIGS. 8 and 9, wall surfaces 146 and 152 are square in cross-section, each defining four abutment surfaces 154 and 156, respectively, and are dimensioned for a precise slip interfit. This arrangement ensures a robust design, able to tolerate relatively high levels of torque.

A radial step 158 formed at the interface of outer and inner edge surfaces 140 and 146, respectively, of outer and inner portions 132 and 134, respectively, of base member 130 precisely axially positions portions 132 and 134, ensuring that upper surfaces 136 and 148 are coplanar and lower surfaces 138 and 150 are coplanar. Step 158 axially interlocks inner and outer portions 132 and 134, respectively, from relative axial displacement in one direction. Inner portion 134 is magnetized to resist axial separation of the inner and outer portions 132 and 134, respectively, in the opposite axial direction. Alternatively, mechanical fastening, such as that described in connection with the embodiment of the invention of FIG. 3 could be substituted. This arrangement provides the advantage of maintaining the axial dimension of spanner socket 128 to an absolute minimum where it must be employed in an axially restricted environment. This improvement is achieved in part by the elimination of a separate, axially upwardly extending extension portion 16 (refer FIGS. 1-3). By minimizing the axial dimension of the spanner socket 128, the inventive design ensures transmission of pure torque loads along axis C-C' with minimum tendency to create damaging offset moment forces.

Inner portion 134 of base member 130 defines a relatively large central through bore 160 disposed concentrically about axis C-C' and extending there through. Bore 160 terminates upwardly through upper surface 148 and downwardly through lower surface 150 of inner portion 134. Bore 160 has a substantially square cross-section dimensioned to nestingly receive a ½ inch drive member 58 of a conventional ratchet driver 60 as described herein in connection with FIG. 3. The square configuration of through bore 160 defines four radially inwardly directed flats or engagement surfaces 162 which receive user applied torque from the four abutting surfaces of the drive member 58 of socket wrench 60.

Four relatively small bores 164, 166, 168 and 170 are formed in the generally cylindrical outer portion 132. The small bores 164, 166, 168 and 170 are circumferentially arranged, with each equally radially spaced from axis C-C' and define a line of extension parallel thereto. Bores 164, 166, 168 and 170 are each also equally spaced from the two circumferentially closest adjacent bores. Each bore receives an axially elongated drive pin 172, 174, 176 and 178, respectively.

Inasmuch as each of the elongated drive pins 172, 174, 176 and 178 vary structurally and functionally somewhat, each will be described herein below.

Bore 164 extends entirely through outer portion 132, maintaining a smooth constant diameter. Drive pin 172 includes a shank portion 180 which forms a snug slip fit within bore 164. A work piece engaging portion 182 extends below lower surface 150. A head portion 184 of greater diameter than shank portion 180 is disposed above and abuts upper surface 136 to limit downward axial displacement of drive pin 172 within bore 164. Head portion 184 of drive pin 172 defines a tool receiving recess 186 which facilitates removal of drive pin 172 with a separate pry tool should work piece engagement portion become worn or damaged.

Bore 166 extends entirely through outer portion 132, maintains a constant diameter and defines a thread form entirely there along. Drive pin 174 includes a threaded shank portion (not illustrated), which engages the threads within bore 166. A work piece engaging portion (not illustrated) extends below lower surface 150. Drive pin 174 has no head portion but, rather, has an adjusting tool receiving recess 188 in the top horizontal surface thereof This arrangement allows selective variable positioning of drive pin 174 through the use of an Allen wrench or the like should it be necessary to lengthen or shorten the extension length of the work piece engaging portion.

Bore 168 extends entirely through outer portion 132 but has a diameter reduction step 190 therein located near the upper surface 148 of outer portion 132. Drive pin 175 includes a shank portion 192, which is press fit within bore 168. A work piece engaging portion 194 extends below lower surface 150. Step 190 defines an upward limit of travel for drive pin 176 as illustrated in FIG. 9. The upper reduced diameter portion 196 of bore 168 provides access for a separate small diameter axial drive pin (not illustrated) should it be necessary to remove drive pin 176.

Bore 170 is a blind bore, extending axially upwardly from lower surface 138 of outer portion 132 and terminating short of upper surface 136. As in the case of drive pin 176 described in the above paragraph, drive pin 178 includes a shank portion (not illustrated) which is press fit upwardly into bore 170 until the upper end of drive pin 178 contacts the closed end of bore 170. A work piece engaging portion 198 extends below lower surface 150.

Each of the four forgoing design variations of the present invention can be employed individually or in combination. For example, many, if not most spanner nuts employ only two tool engaging openings. Thus, it may be convenient to employ a spanner socket design, which has two, opposed, relatively permanently affixed drive pins and two easily removed opposed drive pins.

When assembled as illustrated in FIG. 8, spanner socket 128 can be applied with a ratchet drive 60. With inner portion 134 removed, outer portion 132 can be employed for work pieces with large diameter adjacent structures. In such case, a large wrench could be employed to engage two opposed parallel flats 142 on the outer surface 140 of outer portion 132 of spanner socket 128 in a manner similar to that described hereinabove with respect to the other embodiments of the invention.

It is to be understood that the invention has been described with reference to specific embodiments and variations to provide the features and advantages previously described and that the embodiments are susceptible of modification as will be apparent to those skilled in the art. For example, in applications where axial restrictions in the proximity of the work piece are not an issue, the axial length of the faceted extension portion could be increased and the diameter of the central through bore increased to accommodate work pieces with greater drive/mounting shaft axial extensions. Accordingly, the forgoing is not to be construed in a limiting sense.

The invention has been described in an illustrative manner, and it is to be understood that the terminology, which has been used, is intended to be in the nature of words of description rather than limitation.

Obviously, many modifications and variations of the present invention are possible in light of the above teachings. It is, therefore, to be understood that within the scope of the appended claims wherein reference numerals are merely for illustrative purposes and convenience and are not to be in any way limiting, the invention, which is defined by the following claims as interpreted according to the principals of patent law, including the Doctrine of Equivalents, may be practiced otherwise than as specifically described.

What is claimed is:

1. A spanner socket for application with a driving tool such as a hand-held socket driver including a driving output member operable for releasably coupling with said spanner socket and for engaging a mating surface of a ferrous work piece such as a spanner nut for selectively imparting torque to the work piece through said spanner socket about an axis of rotation, said spanner socket comprising:

a generally cylindrical base member defining a through passage disposed substantially concentrically about said axis of rotation, said through passage extending between a first end surface for positioning adjacent said driving tool and a second end surface for positioning adjacent the mating surface of said work piece, the end of said through passage adjacent the first end surface shaped to define a plurality of circumferentially arranged engagement surfaces for releasably coupling with said driving tool output member for the transmittal of torque there between;

a plurality of elongated drive pins carried by said base member for rotation about said axis of rotation and extending from said second end surface for engaging and applying loosening and tightening torque to a work piece, each said drive pin defining an axis of elongation disposed substantially parallel to said axis of rotation, said drive pins equi-spaced from said axis of rotation for engagement with associated openings in the mating surface of said work piece, each said drive pin defining a shank portion removably affixed to said base member and a work piece engaging portion, said drive pins having at least one radial step formed there along to limit axial positioning of each drive pin with respect to said base member;

a tool receiving recess formed in said base member, said tool receiving recess opening radially outwardly through an outer edge surface of said base member and axially downwardly through said lower surface, said tool receiving recess extending circumferentially about the periphery of said base member and dimensioned for receipt of a pry tool therein at multiple circumferentially spaced locations, in application, to effect axial separation forces between the base member and the work piece; and at least one permanent magnet nestingly embedded within a blind bore within said base member, said permanent magnet flush mounted with the lower surface of said base member to effect magnetic attraction and retention of said work piece against the lower surface of said base member.

2. The spanner socket of claim 1, wherein said drive pins are disposed radially outwardly of said passage.

3. The spanner socket of claim 1, wherein each said drive pin comprises a stepped head portion having a characteristic diameter exceeding the characteristic diameter of said shank portion, said head portion limiting axial positioning of said drive pin with respect to the base member by abutting an upper surface of said base member axially opposed from said lower surface.

4. The spanner socket of claim 1, wherein each said drive pin is fixedly received within a mating bore formed in said base member.

5. The spanner socket of claim 4, wherein each said drive pin is threadably engaged within its associated mating bore.

6. The spanner socket of claim 1, wherein said drive pins are generally round in cross-section.

* * * * *